US006283852B1

(12) United States Patent
Igo

(10) Patent No.: US 6,283,852 B1
(45) Date of Patent: Sep. 4, 2001

(54) ROOFLINE VENTILATOR ASSEMBLY

(75) Inventor: Michael Igo, Dubuque, IA (US)

(73) Assignee: Klauer Manufacturing Company, Dubuque, IA (US)

( * ) Notice: Subject to any disclaimer, the term of this patent is extended or adjusted under 35 U.S.C. 154(b) by 0 days.

(21) Appl. No.: 09/635,464

(22) Filed: Aug. 11, 2000

(51) Int. Cl.[7] ..... F24F 7/00
(52) U.S. Cl. ..... 454/365; 52/199
(58) Field of Search ..... 454/364, 365, 454/366; 52/199

(56) References Cited

U.S. PATENT DOCUMENTS

| | | | |
|---|---|---|---|
| 8,597 | 12/1851 | Speers . | |
| Re. 25,921 | 11/1965 | Smith . | |
| Re. 27,943 | 3/1974 | Smith . | |
| 183,532 | 10/1876 | Brock . | |
| D. 283,839 | 5/1986 | Kutsch et al. . | |
| 835,966 | 11/1906 | Lyster . | |
| 3,481,263 | 12/1969 | Belden . | |
| 4,545,291 | 10/1985 | Kutsch et al. . | |
| 4,848,653 | 7/1989 | Van Becelaere . | |
| 5,277,002 | 1/1994 | Haag . | |
| 5,339,582 | 8/1994 | Sells . | |
| 5,605,022 | 2/1997 | Fulton . | |
| 5,797,222 | 8/1998 | Martin . | |
| 5,924,925 | 7/1999 | Nystron . | |
| 6,000,176 * | 12/1999 | Lancaster | 52/199 X |

* cited by examiner

*Primary Examiner*—Harold Joyce
(74) *Attorney, Agent, or Firm*—Larson & Taylor, PLC

(57) ABSTRACT

A roofline ventilator assembly is disposed longitudinally along a peak of a roof and includes an elongate vent and paired end brackets. Each end bracket includes (a) a central peaked portion, (b) first and second lateral holding portions, (c) respective first and second upper holding members located in a respective first and second holding portion, and (d) respective first and second lower holding members located in the respective first and second holding portion below a respective first and second upper holding member. The vent includes an elongate ridge cap which extends longitudinally between the end brackets and which is attached thereto. The ridge cap includes a central cap portion, and first and second wings extending laterally from opposite sides of the central peaked portion. The vent also includes first and second elongate upper barrier members and first and second elongate lower barrier members which respectively extend longitudinally between the respective first and second holding portions of the end brackets. Each barrier member has an end profile of J shape and is disposed such that opposite longitudinal end portions are held by an associated upper or lower holding member of an associated holding portion. Each lower barrier member and associated upper barrier member form in profile an S-shaped air ventilation path. The vent preferably further includes first and second elongate screen members which are disposed in a respective S-shaped air ventilation path to screen air passing along the respective S-shaped path.

30 Claims, 3 Drawing Sheets

ROOFLINE VENTILATOR ASSEMBLY

FIELD OF THE INVENTION

The present invention relates generally to roofline ventilators for peaked roofs, and more particularly to a roofline ventilator which is inexpensive and easy to assemble accurately and quickly.

BACKGROUND OF THE INVENTION

Numerous roof ventilators are known in the art. However, there are problems with such prior art ventilators including inefficient operation as well as the cost and ease of manufacture and installation thereof.

BRIEF SUMMARY OF THE INVENTION

In accordance with the present invention, a roofline ventilator assembly is disposed longitudinally along a peak of a roof over an elongate opening therein. The ventilator assembly includes an elongate vent and paired end brackets located at a spaced interval from each other along a longitudinal axis adjacent to the peak of the roof. Each end bracket includes (a) a central peaked portion which extends laterally above the peak, (b) first and second holding portions located at opposite lateral sides of the peaked portion, (c) respective first and second upper holding members located in a respective first and second holding portion, and (d) respective first and second lower holding members located in the respective first and second holding portion below a respective first and second upper holding member.

The vent includes an elongate ridge cap which extends longitudinally between the end brackets and which is attached to and extends over a portion of each end bracket. The ridge cap includes (a) a central cap portion which extends laterally over and between respective central peaked portions of underlying end brackets, and (b) first and second wings extending laterally from opposite sides of the central peaked portion to a lateral position beyond the holding portions of the underlying end brackets.

The vent also includes first and second elongate upper barrier members which respectively extend longitudinally between the respective first and second holding portions of the end brackets. Each upper barrier member has an end profile of J shape so that in profile the upper barrier member has a short leg, a long leg parallel to the short leg, and a connecting piece. Each upper barrier member is disposed such that opposite longitudinal end portions of the short leg are held by an associated lower holding member of an associated holding portion with opposite longitudinal end portions of the connecting piece located outside of the associated holding portion and with opposite longitudinal end portions of the long leg located above the associated holding portion and underneath of an associated wing of the ridge cap.

The vent further includes first and second elongate lower barrier members which respectively extend longitudinally between the respective first and second holding portions of the end brackets. Each lower barrier member has an end profile of J shape so that in profile the lower barrier member has a short leg, a long leg parallel to the short leg, and a connecting piece. Each lower barrier member is disposed such that opposite longitudinal end portions of the short leg are held by an associated upper holding member of the associated holding portion with opposite longitudinal end portions of the connecting piece located inside of the associated holding portion and with opposite longitudinal end portions of the long leg located below the associated holding portion and extending away from the end bracket for attachment to the roof. Thus, each lower barrier member and associated upper barrier member form in profile an S-shaped air ventilation path from an area below the central cap portion of the ridge cap to an area outside of the associated holding portion and above an associated long leg of the lower barrier member.

The vent preferably further includes first and second elongate screen members which respectively extend longitudinally between the end brackets. Each screen member (a) is attached to the respective end brackets, and (b) is disposed in a respective S-shaped air ventilation path to screen air passing along the respective S-shaped path. Each screen member preferably has an end profile of J shape so that in profile the screen member has a short leg, a long leg parallel to the short leg, and a connecting piece. Thus, each screen member is disposed such that opposite longitudinal end portions of one of the short leg and long leg are held by an associated one of the upper holding member and lower holding member of the associated holding portion. In the preferred embodiment, each opposite longitudinal end portion of the long leg of the screen members is held by an associated upper holding member of the associated holding portion such that each connecting piece of the screen members is disposed between an associated long leg of the upper barrier member and an associated short leg of the lower barrier member.

The roofline ventilator assembly of the present invention preferably further includes a plurality of mid brackets disposed intermediate the end brackets along the longitudinal axis. Each mid bracket includes (a) a central peaked portion which extends laterally, (b) first and second holding portions located at opposite lateral sides of the peaked portion of the mid bracket, (c) respective first and second upper holding members located in a respective first and second holding portion of the mid bracket, and (d) respective first and second lower holding members located in the respective first and second holding portion of the mid bracket below a respective first and second upper holding member of the mid bracket. With this construction, respective mid portions of respective first and second upper barrier members, respective mid portions of respective first and second lower barrier members, and respective mid portions of respective first and second screen members are respectively received in one of the first and second upper and lower holding members of the mid brackets.

Where the roofline ventilator has a plurality of mid brackets, each screen member includes a plurality of cutouts at spaced intervals in which associated mid brackets are received as the associated screen member is held by the associated the mid bracket.

In the preferred embodiment, the end brackets, the ridge cap, the upper barrier members, the lower barrier members, and the screen members are all made of a plastic material, such as vinyl.

Further in the preferred embodiment, the holding members of the end brackets and of the mid brackets are formed by laterally open slots therein. In each slot, there is provided at least one upper and lower longitudinal bead extending respectively from opposite upper and lower walls defining the slot. More preferably, there are at least three of the beads, with one bead extending from one wall being located laterally intermediate two other beads extending from the other wall.

Each mid bracket preferably includes a lower outside indentation. In addition, each bracket is longitudinally hollow beneath the central peaked portion thereof and is longitudinally hollow about the holding members, except for an outside end wall extending in a vertical plane of the end brackets. Further, a profile of the central peaked portion of each end bracket matches a profile of the ridge cap such that the central peaked portion engages the ridge cap thereat. Still further, the ridge cap has first and second lateral edges which extend beyond the associated holding portions of the mid brackets and which lateral edges are angled down towards the roof.

It is an advantage of the present invention that a roofline ventilator is provided which is easy and cheap to make.

It is also and advantage of the present invention that a roofline ventilator is provided which is easy and quick to install.

It is another advantage of the present invention that a roofline ventilator is provided which is easy to precisely assemble.

Other features and advantages of the present invention are stated in or apparent from detailed descriptions of presently preferred embodiments of the invention found hereinbelow.

DETAILED DESCRIPTION OF THE INVENTION

Figure 2:
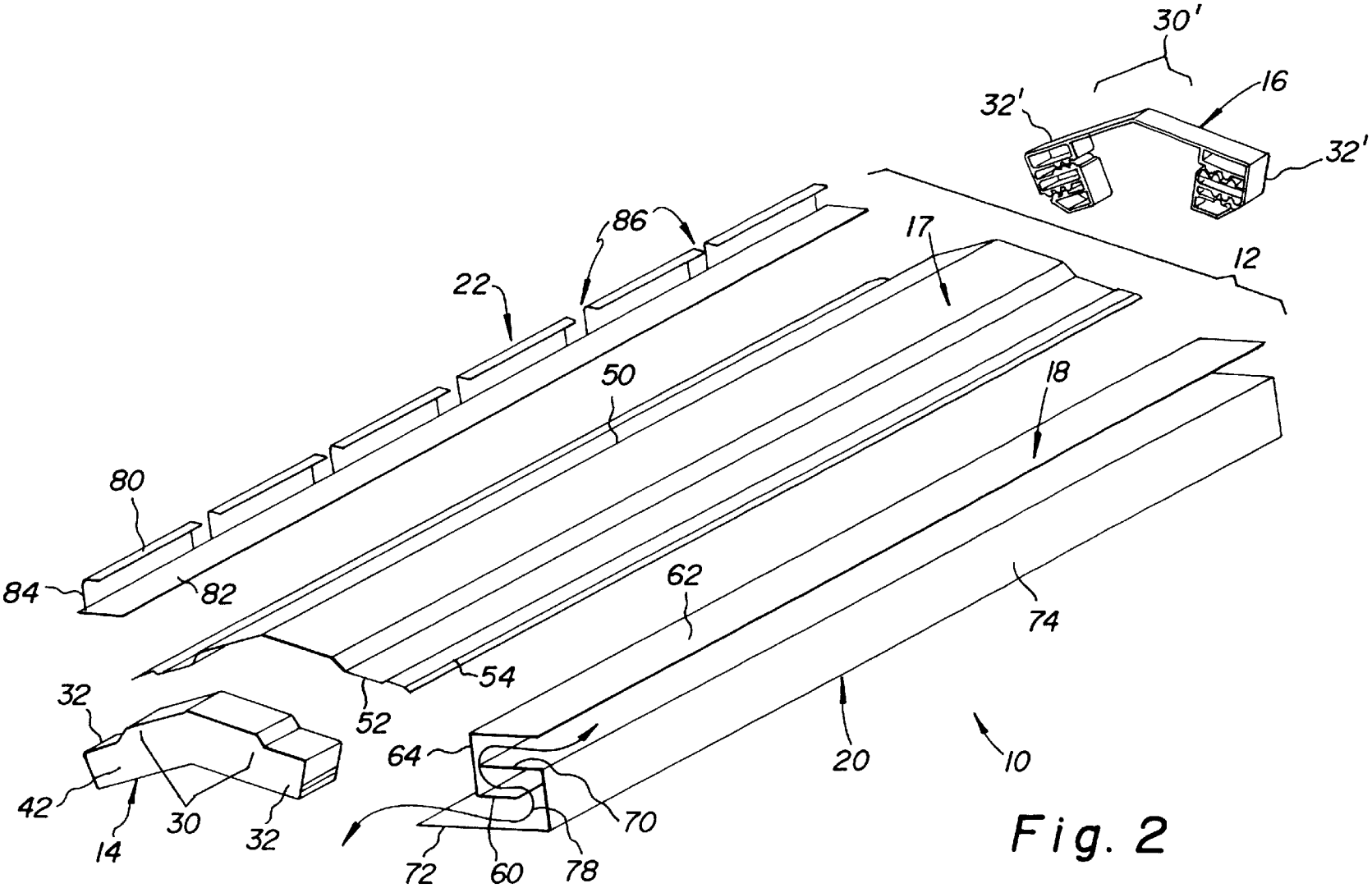
FIG. 2 is a schematic perspective depiction of the various components making up the roofline ventilator depicted in FIG. 1.

With reference now to the drawings in which like numerals represent like elements throughout the views, the various components making up the roofline ventilator assembly 10 of the present invention are schematically depicted in FIG. 2. Roofline ventilator assembly 10 is made up of a vent 12, end brackets 14, and mid brackets 16. Vent 12 includes a ridge cap 17, upper barrier members 18, lower barrier members 20, and screen members 22. Only one each of the components making up roofline ventilator assembly 10 is depicted in FIG. 2, so it must be appreciated that each roofline ventilator assembly 10 includes: two identical paired end brackets 14, one at each longitudinal end of roofline ventilator assembly 10; one or more identical mid brackets 16; a single ridge cap 17; two (left and right, or first and second) identical upper barrier members 18; two (left and right, or first and second) identical lower barrier members 18; and two (left and right, or first and second) identical screen members 18 (note, screen member 18 depicted in FIG. 2 on the left side is oriented for use on the right side, while upper barrier member 18 and lower barrier member 20 on the right side are oriented together for use on the left side).

Figure 1:
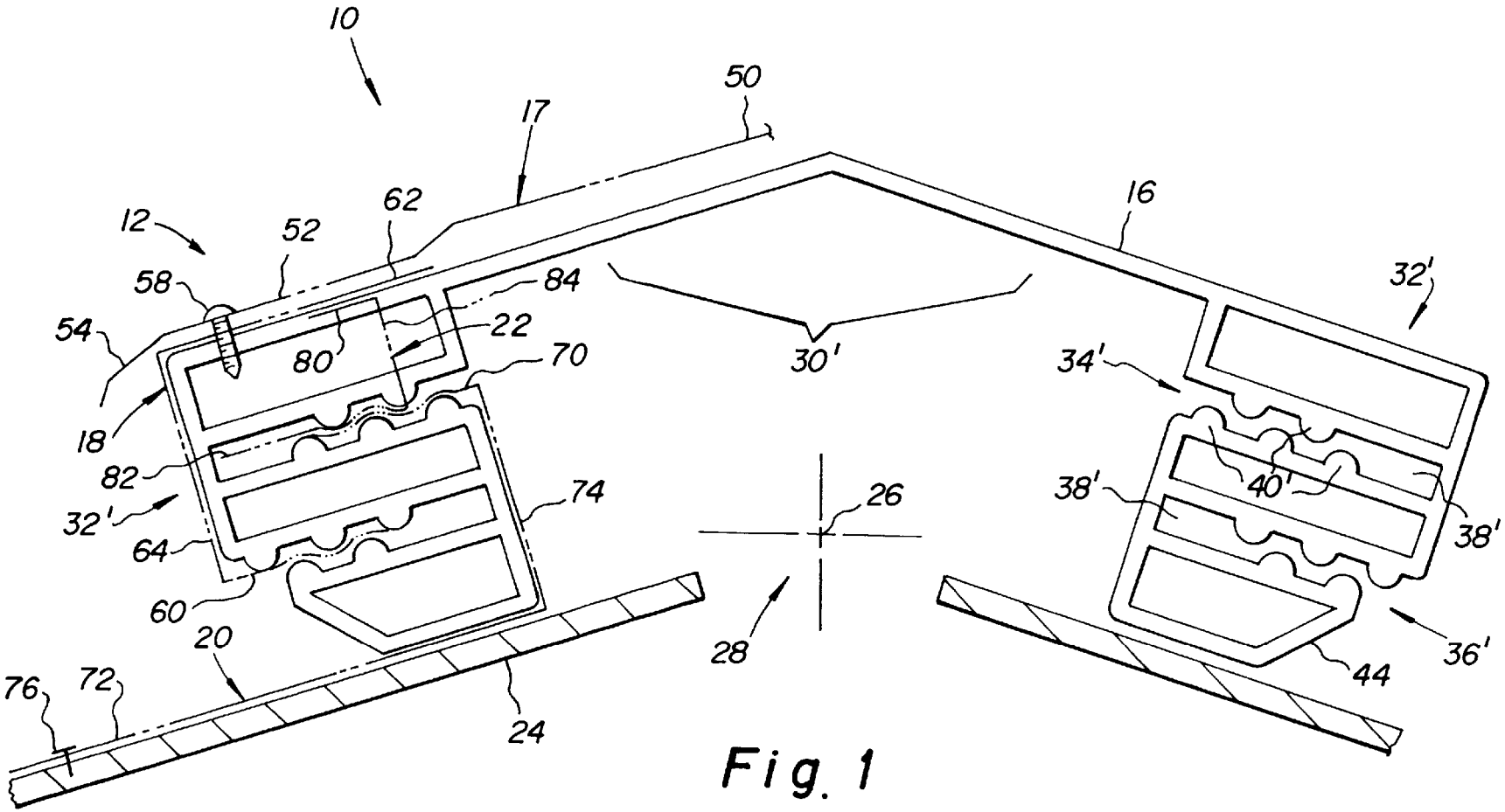
FIG. 1 is a schematic cross-sectional view of a roofline ventilator of the present invention.

It will be appreciated that roofline ventilator assembly 10 is designed to be a modular assembly made in set lengths (e.g., 2, 4, 6, 8, 10, 12, 14, 16, etc. foot lengths) for predetermined roof 24 angles, so as to be mounted along a longitudinal axis 26 above an opening of roof 24 at a peak 28 thereof as shown in FIG. 1. Thus, for the example of a ten foot long ridge ventilator assembly 10, ridge cap 17, barrier members 18 and 20, and screen members 22 are all made in a ten foot length; and preferably a plurality of mid brackets 16, such as five for a ten foot long roofline ventilator assembly 10, are provided (obviously, there are always two end brackets 14). It will also be appreciated that two or more roofline ventilator assemblies 10 can be provided along a single roof, with lengths as required or desired. The components noted above for roofline ventilator assembly 10 are preferably made of a plastic material, which is preferably vinyl, for ease of manufacture, for ease of assembly, for being inexpensive, for durability, and for longevity in use.

Figure 3:
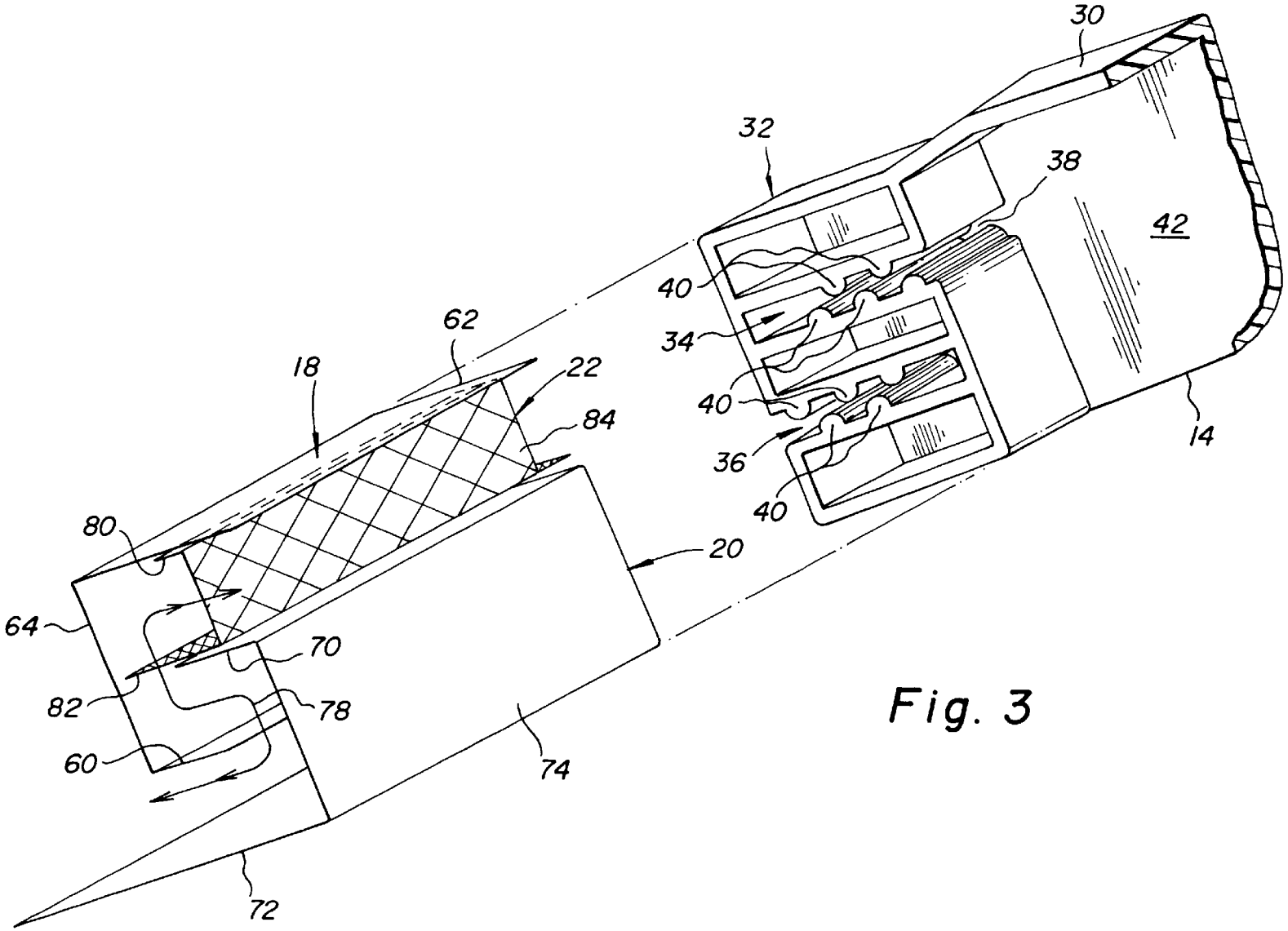
FIG. 3 is a schematic cross-sectional exploded view of portions of an end bracket and of the components received therein as shown in FIG. 1 which form the S-shaped ventilation path.

End brackets 14 are best shown best in FIGS. 2 and 3, while mid brackets 16 are shown in FIGS. 1 and 2. End brackets 14 and mid brackets 16 are similar in shape and use, so that it would be largely redundant to describe each separately. Instead, where similar structures are present in mid brackets 16 that are described with respect to end bracket 14, those same structures will be identified in the drawings with the same numerals used to describe the structures of end bracket 14, but with the addition of a prime (′). The differences between end brackets 14 and mid brackets 16 will be discussed subsequently.

Paired end brackets 14 are located at a predetermined spaced interval (such as ten feet) from each other along longitudinal axis 26 adjacent to peak 28 of roof 24, while mid brackets 16 are then provided at spaced intervals intermediate end brackets 14 as discussed subsequently. Each end bracket 14 (and mid bracket 16) includes: a central peaked portion 30 which extends laterally above peak 28; left and right (first and second) holding portions 32 located at opposite lateral sides of peaked portion 30; respective left and right (first and second) upper holding members 34 located in a respective holding portion 32; and respective left and right (first and second) lower holding members 36 located in the respective holding portion 32 below a respective upper holding member 34. Holding members 34 and 36 are preferably formed by laterally open slots 38 therein which open from opposite lateral sides of holding portions 32. In each slot 38, there is provided a plurality of longitudinal beads 40. There should be at least one upper and lower longitudinal bead 40 extending respectively from opposite upper and lower walls defining slot 38. However, preferably there are at least three beads 40, with one bead 40 extending from one wall and being located laterally intermediate two other beads 40 extending from the other wall (and in the depicted most preferred embodiment, there are five interdigitated beads 40). In order to conserve material and make each end bracket 14 (and mid bracket 16) lightweight and inexpensive, each bracket 14 is longitudinally hollow beneath central peaked portion 30 thereof and is longitudinally hollow about holding members 34 and 36.

The differences between end brackets 14 and mid brackets 16 are driven by their different uses. As each end bracket 14 is used as a longitudinal end cap, each end bracket further includes an outside end wall 42 extending in a vertical plane of end bracket 14. Further, a profile of central peaked portion 30 of each end bracket 14 matches a profile of ridge cap 17, such that central peaked portion 30 engages ridge cap 17 thereat; whereas mid brackets 16 do not have such a profile and engage ridge cap 17 only adjacent the lateral portions thereof. Each mid bracket 16 also preferably includes a lower outside indentation 44 which is not present on end brackets 14, which indentations makes mid brackets 16 more or less invisible or unobtrusive after roofline ventilator assembly 10 is assembled (as discussed hereinafter).

Ridge cap 17 is elongate as shown in FIG. 2 and extends longitudinally between end brackets 14 when roofline ventilator assembly 10 is assembled. At each end, ridge cap 17 is attached to and extends over a portion of each end bracket 14 as shown in a similar manner for mid bracket 16 in FIG. 1. Ridge cap 17 includes a central cap portion 50 which extends over respective central peak portions 30 and 30' of underlying end brackets 14 and mid brackets 16. In addition, ridge cap 17 includes left and right (or first and second) wings 52 extending laterally from opposite sides of central peaked portion 50. It will be appreciated that wings 52 of ridge cap 17 each have a lateral edge 54 which extends beyond end brackets 14 and mid brackets 16 and which is angled down towards the roof. Preferably, ridge cap 17 is attached to mid brackets 16 by passing a suitable screw 58 through wings 52 and into an underlying holding portion 32 end brackets 16. Similarly, ridge cap 17 is attached to end brackets 14 with the use of similar screws (not shown) which pass through wings 52, and ridge cap 17 is optionally attached as well to end brackets 14 with screws (not shown) which pass through central peak portion 50 of ridge cap 17 and into the matching profile underneath of central peak portion 30 of end brackets 14.

Each upper barrier member 18 respectively extends longitudinally between end brackets 14, and is secured to and supported by end brackets 14 and mid brackets 16. Each upper barrier member 18 has an end profile of generally J shape so that in profile upper barrier member 18 has a short leg 60, a long leg 62 parallel to short leg 60, and a connecting piece 64. Each upper barrier member 18 is disposed such that opposite longitudinal end portions of short leg 60 are held by an associated lower holding member 36 of an associated holding portion 32 with opposite longitudinal end portions of connecting piece 64 located outside of but adjacent to the associated holding portion 32 and with opposite longitudinal end portions of long leg 62 located above the associated holding portion 32 and underneath of an associated wing 52 of ridge cap 17. Similarly, respective mid portions of each upper barrier member 18 intermediate the longitudinal end portions are disposed with respect to corresponding structures of mid brackets 16 as shown in FIG. 1.

Similar to upper barrier members 18, each lower barrier member 20 respectively extends longitudinally between end brackets 14, and is secured to and supported by end brackets 14 and mid brackets 16. Each lower barrier member 20 has an end profile of J shape, which it will be noted is not the same as that of upper barrier member 18, so that in profile lower barrier member 20 has a short leg 70, a long leg 72 parallel to short leg 70, and a connecting piece 74. Each lower barrier member 20 is disposed such that opposite longitudinal end portions of short leg 70 are held by an associated upper holding member 34 of the associated holding portion 32 with opposite longitudinal end portions of connecting piece 74 located inside of the associated holding portion 32 and with opposite longitudinal end portions of long leg 72 located below the associated holding portion 32 and extending away from end bracket 14 for attachment to roof 24 as by a nail 76. Similarly, respective mid portions of each lower barrier member 20 intermediate the longitudinal end portions are disposed with respect to corresponding structures of mid brackets 16 as shown in FIG. 1.

With the above noted construction, each lower barrier member 20 and associated upper barrier member 18 form in profile an S-shaped air ventilation path 78 (either in or out as needed) as shown in FIGS. 2 and 3 by the line with arrows. Air path 78 extends from an area below central cap portion 50 of ridge cap 17 to an area outside of the associated holding portion 34 and above an associated long leg 72 of lower barrier member 20. The S shape of air path 78 prevents rain or the like from entering underneath ridge cap 17.

As noted above, vent 12 preferably includes left and right (first and second) elongate screen members 22 which respectively extend longitudinally between end brackets 14. Each screen member is secured to and supported by respective end brackets 14 and mid brackets 16 so as to be disposed in a respective S-shaped air ventilation path 78 to screen the air passing along the respective S-shaped path 78 and hence to prevent debris or vermin from entering the opening in roof 24. Each screen member 22 preferably has an end profile of J shape (not identical to either barrier members 18 and 20) so that in profile screen member 22 has a short leg 80, a long leg 82 parallel to short leg 80, and a connecting piece 84. Thus, each screen member 22 is disposed such that opposite longitudinal end portions of one of short leg 80 or long leg 82 are held by an associated one of upper holding members 34 or lower holding members 36 of the associated holding portions 32 of end brackets 14; and such that various mid portions are similarly held by respective holding member 32' or 34' of mid brackets 16.

In the preferred embodiment depicted, each opposite longitudinal end portion of long leg 82 of screen members 22 is held by an associated upper holding member 34 or 34' of associated holding portions 32 and 32' such that the distal part of long leg 82 extends almost to connecting piece 64 of upper barrier member 18 to screen air flowing along the S-shaped air flow path 78. With this configuration, each connecting piece 84 of screen members 22 is disposed between an associated long leg 62 of upper barrier member 18 and an associated short leg 70 of lower barrier member 20. In addition, it will be appreciated that short leg 80 and connecting piece 84 are cut away slightly at each longitudinal end to allow room for the associated holding portion 32 of end brackets 14. Similarly, each screen member 22 includes a plurality of cutouts 86 at spaced intervals in which associated mid brackets 16 are received as the associated long leg 82 of each screen member 22 is held by the associated upper holding member 34' of mid brackets 16. Cutouts 86 thus provide a convenient and foolproof way of spacing mid brackets 16 along vent 12.

In use, roofline ventilator assembly 10 is easily and simply constructed as follows, after the length of the opening to be covered in roof 24 as well as the angle of peak 28 of roof 24 are known and the appropriate roofline ventilator assembly 10 acquired therefor. In the present depicted embodiment, the length of roofline ventilator assembly 10 is ten feet, and the peak angle is 145° (the angle between the two sides of roof 24). Assuming that the length of roofline ventilator assembly 10 is sufficient to require mid brackets 16 as in this present embodiment, holding portions 32' on one side of mid brackets 16 are first positioned along one screen member 22, with adjacent (mid) portions of long leg 82 thereof being forcibly received into each slot 38' and bent by passing beads 40' therein to securely hold screen member 22 thereto. Cutouts 86 are provided at predetermined intervals in order to properly position mid brackets 16 and end brackets 14 along vent 12 for proper support and attachment of the associated elements.

Once mid brackets 16 are in place on screen member 22, upper barrier member 18 is longitudinally aligned with screen member 22 and then attached to mid brackets 16 by forcibly pushing mid (adjacent) portions of short leg 60 into slot 38' of lower holding portion 36' thereby deforming the mid portions; and lower barrier member 20 is similarly attached to mid brackets 16 by forcibly pushing mid (adjacent) portions of short leg 70 into slot 38' of upper holding portion 34' thereby deforming the mid portions. Next, in a similar manner, the other screen member 22 and other barrier members 18 and 20 for the other side of mid brackets 16 are positioned on mid brackets 16. With this construction accomplished, end brackets 14 are then positioned onto the assembly of mid brackets 16, screen members 22, lower barrier members 20 and upper barrier members 18. This can be accomplished either by longitudinally pressing end brackets onto the longitudinal ends of the associated members or laterally on the longitudinal ends in the same lateral manner as mid brackets 16 were attached thereto, whichever is easier or desired.

With upper barrier members 18, lower barrier members 20 and screen members 22 securely (deformably and frictionally) held to brackets 14 and 16, a rigid vent assembly is provided. If desired, ridge cap 17 can then be mounted thereto by suitable screws 58 passing therethrough and through long leg 62 of upper barrier members 28 into the underlying holding portion 32 or 32'. The desired position of ridge cap 17 is achieved by the matching central peaked portions profiles of ridge cap 17 and end caps 14—and it will be noted that mid brackets 16 without similar profiles thus do not interfere with this alignment. Alternatively or thereafter, the rigid vent assembly is located on roof 24 over peak 28 and nails 76 passed through long legs 72 of lower barrier members 20 to secure the rigid vent assembly to roof 24 (at which time ridge cap 17 is attached thereto as discussed above if not already in place).

In this preferred embodiment, brackets 14 and 16 are made of vinyl and have wall thicknesses of about 0.15". These brackets 14 and 16 are 1.5" wide (in the longitudinal direction), about 6" measured from the peak to the outside edge of holding portion 32 or 32', and 3" in height (measured parallel to a connecting leg of the barrier members). Such dimensions and associated dimensions of barrier members 18 and 20 provide a continuous air path 78 having a one inch continuous opening. Obviously, other dimensions and sizes can be used as desired.

As noted above, roofline ventilator assembly 10 can be of such a short dimension that mid brackets 16 are not required. However, it is anticipated that relatively long lengths of roofline ventilator assembly 10 will be used for efficiency, so that mid brackets 16 will typically be required. In addition, while screen member 22 is optional, it is usually higher desired and will likewise usually be provided in roofline ventilator assembly 10.

While the present invention has been described with respect to exemplary embodiments thereof, it will be understood by those of ordinary skill in the art that variations and modifications can be effected within the scope and spirit of the invention.

I claim:

1. A roofline ventilator assembly which is disposed longitudinally along a peak of a roof comprising:

paired end brackets located at a spaced interval from each other along a longitudinal axis adjacent to the peak of the roof, each said end bracket including a) a central peaked portion which extends laterally above the peak, b) first and second holding portions located at opposite lateral sides of said peaked portion, c) respective first and second upper holding members located in a respective said first and second holding portion, and d) respective first and second lower holding members located in the respective said first and second holding portion below a respective said first and second upper holding member;

an elongate ridge cap which extends longitudinally between said end brackets and which is attached to and extends over a portion of each said end bracket, said ridge cap including a) a central cap portion which extends over and between respective said central peaked portions of underlying said end brackets, and b) first and second wings extending laterally from opposite sides of said central peaked portion to a lateral position beyond said holding portions of the underlying said end brackets;

first and second elongate upper barrier members which respectively extend longitudinally between the respective said first and second holding portions of said end brackets, a) wherein each said upper barrier member has an end profile of J shape so that in profile said upper barrier member has a short leg, a long leg parallel to said short leg, and a connecting piece, and b) wherein each said upper barrier member is disposed such that opposite longitudinal end portions of said short leg are held by an associated said lower holding member of an associated said holding portion with opposite longitudinal end portions of said connecting piece located outside of the associated said holding portion and with opposite longitudinal end portions of said long leg located above the associated said holding portion and underneath of an associated said wing of said ridge cap; and first and second elongate lower barrier members which respectively extend longitudinally between the respective said first and second holding portions of said end bracket a) wherein each said lower barrier member has an end profile of J shape so that in profile said lower barrier member has a short leg, a long leg parallel to said short leg, and a connecting piece, b) wherein each said lower barrier member is disposed such that opposite longitudinal end portions of said short leg are held by an associated said upper holding member of the associated said holding portion with opposite longitudinal end portions of said connecting piece located inside of the associated said holding portion and with opposite longitudinal end portions of said long leg located below the associated said holding portion and extending away from said end bracket for attachment to the roof, and c) wherein each said lower barrier member and associated said upper barrier member form in profile an S-shaped air ventilation path from an area below said central cap portion of said ridge cap to an area outside of the associated said holding portion and above an associated said long leg of said lower barrier member.

2. A roofline ventilator assembly as claimed in claim 1, further including:

first and second elongate screen members which respectively extend longitudinally between said end brackets, each said screen member (a) being attached to the respective said end brackets, and (b) being disposed in a respective S-shaped air ventilation path to screen air passing along the respective S-shaped path.

3. A roofline ventilator assembly as claimed in claim 2;

wherein each said screen member has an end profile of J shape so that in profile said screen member has a short leg, a long leg parallel to said short leg, and a connecting piece; and wherein each said screen member is disposed such that opposite longitudinal end portions of one of said short leg and long leg are held by an associated one of said upper holding member and lower holding member of the associated said holding portion.

4. A roofline ventilator assembly as claimed in claim 3, wherein each opposite longitudinal end portion of said long leg of said screen members is held by an associated said upper holding member of the associated said holding portion such that each said connecting piece of said screen members is disposed between an associated said long leg of said upper barrier member and an associated said short leg of said lower barrier member.

5. A roofline ventilator assembly as claimed in claim 3:

further including a plurality of mid brackets disposed intermediate said end brackets along the longitudinal axis, each said mid bracket including a) a central peaked portion which extends laterally, b) first and second holding portions located at opposite lateral sides of said peaked portion of said mid bracket, c) respective first and second upper holding members located in a respective said first and second holding portion of said mid bracket, and d) respective first and second lower holding members located in the respective said first and second holding portion of said mid bracket below a respective said first and second upper holding member of said mid bracket; and wherein respective mid portions of respective said first and second upper barrier members, respective mid portions of respective said first and second lower barrier members, and respective mid portions of respective said first and second screen members are respectively received in one of said first and second upper and lower holding members of said mid brackets.

6. A roofline ventilator assembly as claimed in claim 5, wherein each said screen member includes a plurality of cutouts at spaced intervals in which associated said mid brackets are received as the associated said screen member is held by the associated said mid bracket.

7. A roofline ventilator assembly as claimed in claim 5, wherein said end brackets, said ridge cap, said upper barrier members, said lower barrier members, and said screen members are made of a plastic material.

8. A roofline ventilator assembly as claimed in claim 7, wherein the plastic material is vinyl.

9. A roofline ventilator assembly as claimed in claim 5, wherein said holding members of said end brackets and of said mid brackets are formed by laterally open slots therein, and in each said slot there is provided at least one upper and lower longitudinal bead extending respectively from opposite upper and lower walls defining said slot.

10. A roofline ventilator assembly as claimed in claim 9, wherein there are at least three of said beads, with one said bead extending from one said wall being located laterally intermediate two other said beads extending from the other said wall.

11. A roofline ventilator assembly as claimed in claim 5, wherein each said mid bracket includes a lower outside indentation.

12. A roofline ventilator assembly as claimed in claim 5, wherein said mid brackets are longitudinally hollow beneath said central peaked portion thereof.

13. A roofline ventilator assembly as claimed in claim 12, wherein said mid brackets are longitudinally hollow about said holding members.

14. A roofline ventilator assembly as claimed in claim 13, wherein each said end bracket is longitudinally hollow beneath said central peaked portion thereof and is longitudinally hollow about said holding members, except for an outside end wall extending in a vertical plane.

15. A roofline ventilator assembly as claimed in claim 14, wherein a profile of said central peaked portion matches a profile of said ridge cap such that said central peaked portion engages said ridge cap thereat.

16. A roofline ventilator assembly as claimed in claim 5, wherein said ridge cap has first and second lateral edges which extend beyond the associated said holding portions of said mid brackets and which said lateral edges are angled down towards the roof.

17. A roofline ventilator assembly as claimed in claim 1:

further including at least one mid bracket disposed intermediate said end brackets along the longitudinal axis, said at least one mid bracket including a) a central peaked portion which extends laterally, b) first and second holding portions located at opposite lateral sides of said peaked portion of said mid bracket, c) respective first and second upper holding members located in a respective said first and second holding portion of said mid bracket, and d) respective first and second lower holding members located in the respective said first and second holding portion of said mid bracket below a respective said first and second upper holding member of said mid bracket; and wherein respective mid portions of respective said first and second upper barrier members and respective mid portions of respective said first and second lower barrier members are respectively received in said first and second upper and lower holding members of said mid bracket.

18. A roofline ventilator assembly which is disposed longitudinally along a peak of a roof comprising:

paired end brackets located at a spaced interval from each other along a longitudinal axis adjacent to the peak of the roof, each said end bracket including a) first and second holding portions located at opposite lateral sides thereof, b) respective first and second upper holding members located in a respective said first and second holding portion, and c) respective first and second lower holding members located in the respective said first and second holding portion below a respective said first and second upper holding member;

an elongate ridge cap which extends longitudinally between said end brackets and which is attached to and extends over a portion of each said end bracket, said ridge cap including a) a central cap portion which extends over and between respective said central peaked portions of underlying said end brackets, and b) first and second wings extending laterally from and between opposite sides of said central peaked portion to said holding portions of the underlying said end brackets;

first and second elongate upper barrier members which respectively extend longitudinally between the respective said first and second holding portions of said end brackets, a) wherein each said upper barrier member has an end profile defining a first leg, a second leg spaced from said first leg, and a connecting piece connecting said first leg and said second leg, and b) wherein each said upper barrier member is disposed such that opposite longitudinal end portions of said first leg are held by an associated said lower holding member of an associated said holding portion with opposite longitudinal end portions of said connecting piece located outside of the associated said holding portion and with opposite longitudinal end portions of said second leg located above the associated said holding portion and underneath of an associated said wing of said ridge cap; and first and second elongate lower barrier members which respectively extend longitudinally between the respective said first and second holding portions of said end brackets, a) wherein each said lower barrier member has an end profile defining a first leg, a second leg spaced from said first leg, and a connecting piece connecting said first leg and said second leg of said lower barrier member, b) wherein each said lower barrier member is disposed such that opposite longitudinal end portions of said first leg are held by an associated said upper holding member of the associated said holding portion with opposite longitudinal end portions of said connecting piece located inside of the associated said holding portion and with opposite longitudinal end portions of said second leg located below the associated said holding portion and extending away from said end bracket for attachment to the roof, and c) wherein each said lower barrier member and associated said upper barrier member form in profile a non-linear air ventilation path from an area below said central cap portion of said ridge cap to an area outside of the associated said holding portion and above an associated said second leg of said lower barrier member.

19. A roofline ventilator assembly as claimed in claim 18:

further including a plurality of mid brackets disposed intermediate said end brackets along the longitudinal axis, each said mid bracket including a) first and second holding portions located at opposite lateral sides thereof, b) respective first and second upper holding members located in a respective said first and second holding portion of said mid bracket, and c) respective first and second lower holding members located in the respective said first and second holding portion of said mid bracket below a respective said first and second upper holding member of said mid bracket; and wherein respective mid portions of respective said first and second upper barrier members and respective mid portions of respective said first and second lower barrier members are respectively received in one of said first and second upper and lower holding members of said mid brackets.

20. A roofline ventilator assembly as claimed in claim 19, further including:

first and second elongate screen members which respectively extend longitudinally between said end brackets, each said screen member (a) being attached to the respective said end brackets, (b) being attached to respective said mid brackets at mid portions thereof, and (c) being disposed in a respective S-shaped air ventilation path to screen air passing along the respective S-shaped path.

21. A roofline ventilator assembly as claimed in claim 20, wherein said barrier members and said screen members have an end profile of J shape.

22. A roofline ventilator assembly which is disposed longitudinally along a peak of a roof comprising:

an elongate vent adapted to be mounted over an elongate opening formed at the peak of the roof, said elongate vent comprising in cross section (a) a ridge cap having a central peaked portion and first and second wings extending laterally from said central peaked portion generally in a shape of the peak of the roof, (b) first and second upper barrier members of J-shape so that in profile each said upper barrier member has a short leg, a long leg parallel to said short leg, and a connecting piece, respective said first and second upper barrier members being disposed beneath a respective said first and second wing such that said long leg of said upper barrier member is adjacent said wing of said ridge cap, (c) first and second lower barrier members of J-shape so that in profile each said lower barrier member has a short leg, a long leg parallel to said short leg, and a connecting piece, respective said first and second lower barrier members being disposed with said short leg thereof between said long leg and said short leg of an associated said upper barrier member such that said long leg of said lower barrier member is adjacent the roof, wherein each said lower barrier member and associated said upper barrier member form in profile an S-shaped air ventilation path from the opening below said central cap portion of said ridge cap to an area outside of said vent; and a plurality of spaced brackets to which are attached and which hold in place said ridge cap, said first and second upper barrier members and said first and second lower barrier members.

23. A roofline ventilator assembly as claimed in claim 22:

wherein said elongate vent further includes first and second elongate screen members, respective said first and second screen members being disposed in a respective S-shaped air ventilation path to screen air passing along the respective S-shaped path; and wherein said first and second screen members are attached to and held in place by said plurality of spaced brackets.

24. A roofline ventilator assembly as claimed in claim 23, wherein each said first and second screen member is of J shape so that in profile said screen member has a short leg, a long leg parallel to said short leg, and a connecting piece, with said long leg thereof adjacent said short leg of an associated said lower barrier member such that said short leg of said screen member is adjacent said long leg of an associated said upper barrier member.

25. A roofline ventilator assembly as claimed in claim 24, wherein said plurality of brackets includes paired end brackets which close the profile of respective longitudinal ends of said elongate vent.

26. A roofline ventilator assembly as claimed in claim 25, wherein each said bracket includes a) a central peaked portion which extends laterally, b) first and second holding portions located at opposite lateral sides of said peaked portion of said bracket, c) respective first and second upper holding members located in a respective said first and second holding portion of said bracket, and d) respective first and second lower holding members located in the respective said first and second holding portion of said bracket below a respective said first and second upper holding member of said bracket; and wherein respective portions of respective said first and second upper barrier members, respective portions of respective said first and second lower barrier members, and respective portions of respective said first and second screen members are respectively received in one of said first and second upper and lower holding members of said brackets.

27. A roofline ventilator assembly as claimed in claim 26, wherein each said screen member includes a plurality of cutouts at spaced intervals in which associated said mid brackets are received as the associated said screen member is held by the associated said mid bracket.

28. A roofline ventilator assembly as claimed in claim 27, wherein said holding portions of said brackets and of said mid brackets are formed by laterally open slots therein, and in each said laterally open slot there is provided at least one upper and lower longitudinal bead extending respectively from opposite upper and lower walls defining said slot.

29. A roofline ventilator assembly as claimed in claim 28, wherein said ridge cap has first and second lateral edges which extend beyond the associated said holding members of said brackets and which said lateral edges are angled down towards the roof.

30. A roofline ventilator assembly as claimed in claim 29, wherein said brackets, said ridge cap, said upper barrier members, said lower barrier members, and said screen members are made of a plastic material.

* * * * *